US008752814B1

(12) United States Patent
Oliveto

(10) Patent No.: US 8,752,814 B1
(45) Date of Patent: Jun. 17, 2014

(54) DEVICE TO FACILITATE CLASPING OF JEWELRY

(76) Inventor: Maureen A. Oliveto, Highland Mills, NY (US)

( * ) Notice: Subject to any disclaimer, the term of this patent is extended or adjusted under 35 U.S.C. 154(b) by 0 days.

(21) Appl. No.: 13/459,063

(22) Filed: Apr. 27, 2012

Related U.S. Application Data

(60) Provisional application No. 61/479,691, filed on Apr. 27, 2011.

(51) Int. Cl.
*B25B 1/22* (2006.01)

(52) U.S. Cl.
USPC ..... 269/71; 278/121; 24/3.2; 211/85.2

(58) Field of Classification Search
USPC ..... 269/71, 131, 95, 55, 289 R, 130, 165, 269/228, 201; 29/281.1; 211/85.2
See application file for complete search history.

(56) References Cited

U.S. PATENT DOCUMENTS

| | | | | | |
|---|---|---|---|---|---|
| 2,896,890 | A * | 7/1959 | Hlavac | 248/122.1 |
| 2,926,875 | A * | 3/1960 | Hoye | 248/121 |
| 3,242,540 | A * | 3/1966 | Mitchell | 24/3.1 |
| 4,734,973 | A * | 4/1988 | Longo et al. | 29/428 |
| 4,779,312 | A * | 10/1988 | Carlson | 24/3.2 |
| 4,936,466 | A * | 6/1990 | Nava | 211/85.2 |
| 5,741,035 | A * | 4/1998 | Glass | 294/25 |
| 5,826,843 | A * | 10/1998 | Sturm | 248/176.1 |
| 6,095,346 | A * | 8/2000 | Idelberger | 211/85.2 |
| D479,098 | S * | 9/2003 | Ancona | D7/601 |
| 6,854,625 | B2 * | 2/2005 | Tedeschi | 223/111 |
| 8,297,605 | B2 * | 10/2012 | Lee et al. | 269/75 |
| 2006/0065613 | A1 * | 3/2006 | McKay | 211/85.2 |
| 2011/0049313 | A1 * | 3/2011 | Stephens-De Alanis | 248/121 |
| 2013/0168342 | A1 * | 7/2013 | Yatscoff | 211/85.2 |

* cited by examiner

*Primary Examiner* — Lee D Wilson
*Assistant Examiner* — Melanie Alexander
(74) *Attorney, Agent, or Firm* — Calhelha & Doyle LLC

(57) ABSTRACT

A device and method to facilitate wearing of jewelry items which have hoop and clasp closures, comprising: a base or clamp for stabilizing the device on a surface; a wire guide member protruding from the base and affixed securely thereto, the wire guide having hook at its opposite end for engaging a distal hoop or link on an unclasped jewelry item, thereby permitting a person to: a. engage one end of a jewelry object with a device, b. open a complementary jewelry clasp with one or both free hands, c. position a wrist or neck within the bight of the jewelry item, d. close the clasp upon the hoop link, and e. slidably remove the clasped jewelry item from the device.

9 Claims, 6 Drawing Sheets

DEVICE TO FACILITATE CLASPING OF JEWELRY

FIELD OF THE INVENTION

The present invention relates to a device and method to assist manipulation of a jewelry work piece such as a bracelet or necklace.

BACKGROUND OF THE INVENTION

It is often very difficult for an individual to manipulate the clasps on jewelry and the like. Fumbling with a clasp can lead to frustration, broken fingernails and broken jewelry. The assistance of a companion is not always dependable either.

Accordingly, an efficient and inexpensive aid for putting on a troublesome bracelet or necklace is a desirable goal.

To facilitate attachment of such a jewelry work piece, when help is unavailable, a new device and method of manipulation is proposed herein. In effect, the device gives a third hand to help put on jewelry with ease.

SUMMARY OF THE INVENTION

The subject device and method will facilitate wearing of jewelry items which have hoop and clasp closures. The device is comprised of a base or clamp for stabilizing the device on a surface; a wire guide member attached to the base and affixed securely thereto, whereby the wire guide has a hook or loop at its opposite end configured for engaging a distal hoop or link on an unclasped jewelry item, such as a bracelet or necklace.

The subject design permits a person to a) engage one end of a jewelry object with the jewelry, b) open an opposite and complementary jewelry clasp with one or both free hands, c) position a wrist or neck within the bight of the jewelry item, d) close the clasp upon the hoop or link, and e) slidably remove the clasped jewelry item from the device.

The base or clamp can rest on or be affixed to a horizontal or vertical surface (e.g. table or wall), or in alternative embodiments, may be clamped to a stabilizing member such as a chair, post or article of clothing.

In a further variation, a clip (e.g. an alligator clip) may be additionally added to the device on an additional vertical member.

It will be recognized that the generally vertical member for holding the jewelry object can be fastened to a fixed piece of furniture or other secure frame in a permanent installation, rather than upon the above described portable base.

A jewelry assistance apparatus comprising: a base for stabilizing the apparatus during use; a generally vertical and rigid member extending from the base, the vertical member having at least two portions comprising a lower portion secured to the base and an upper portion, the upper portion having sequential bends such that a bend furthest from the base end and at the distal end of the vertical member points in a generally upwards direction and an upper end point of the vertical member presented to a user for engaging a portion of a jewelry object and configured for maintaining its position as it is fastened by a user of the device.

The vertical member of the subject apparatus has a distal U-shaped loop for engaging the jewelry object and configured for permitting the jewelry object to rest therein. The vertical member has a lower portion that is a wire or pipe having a diameter relatively larger than the upper portion of the vertical member, thereby providing additional support to the jewelry assistance apparatus. The upper portion of the vertical member has a diameter relatively smaller than the lower portion and configured to engage a jewelry object for manipulation by a user.

The upper portion of the vertical member has a first bend extending back toward the base. The vertical member has at least a second bend in it such that the distal end points in a generally upwards direction.

The upper portion of the vertical member of the apparatus further comprises a stopper between the distal and base ends of the vertical member, often a decorative bead. The stopper is engaged with the distal loop and configured to prevent a jewelry object from traversing a further length of the vertical member.

The apparatus may additionally have a distal "cap" member, or a clip, clasp or clamp member, such as an alligator clip. Additionally, in some embodiments, the apparatus may further comprise a friction grip configured to fasten a twist clasp.

The above described apparatus, may be utilized in a method for facilitating the wearing of jewelry as follows. A method for facilitating the wearing of certain types of lengthy jewelry, such as bracelets and necklaces, comprising the steps of: engaging one end of a jewelry object with a device comprising a base or clamp for stabilizing the device on a surface; a wire guide member orthogonal to the base and affixed securely thereto, the wire guide having hook or loop at its opposite end for engaging a distal hoop link on an unclasped jewelry item, thereafter; opening a complementary jewelry clasp with one or both free hands; positioning a wrist or neck within the bight of the jewelry item; closing the clasp upon the hoop link; and slidably removing the clasped jewelry item from the device.

Accordingly, other objects, features and advantages of the present invention will be apparent when the detailed descriptions of the preferred embodiments of the invention are considered with reference to the accompanying drawings, which should be construed in an illustrative and not limiting sense as follows:

DETAILED DESCRIPTION OF THE PREFERRED EMBODIMENTS

The subject device is useful on a wide variety of jewelry work pieces, collectively called jewelry, bracelets or necklaces as the context may dictate. Generally the pieces will have hoops, clasps, closures, latches, backings and the like which require coordinated manipulation for properly attaching to a wrist, neck, etc. Such manipulation is often difficult, inefficient, time consuming and sometimes impossible for certain users.

The subject apparatus will typically have a sturdy base or attachment to a fixed or secure surface, a clamp for facilitating manipulation of the jewelry in coordination with a wrist or neck using a clip, clasp or leverage point. Preferably the clamp is a wire guide as described in detail below. In this specification, the following terms are used in their broadest sense: knot, tie, wall mount, base, horizontal, vertical, and angular or orthogonal relationships between wire guide and base.

In the following description, like-numbered elements represent the same parts throughout.

Figure 1:
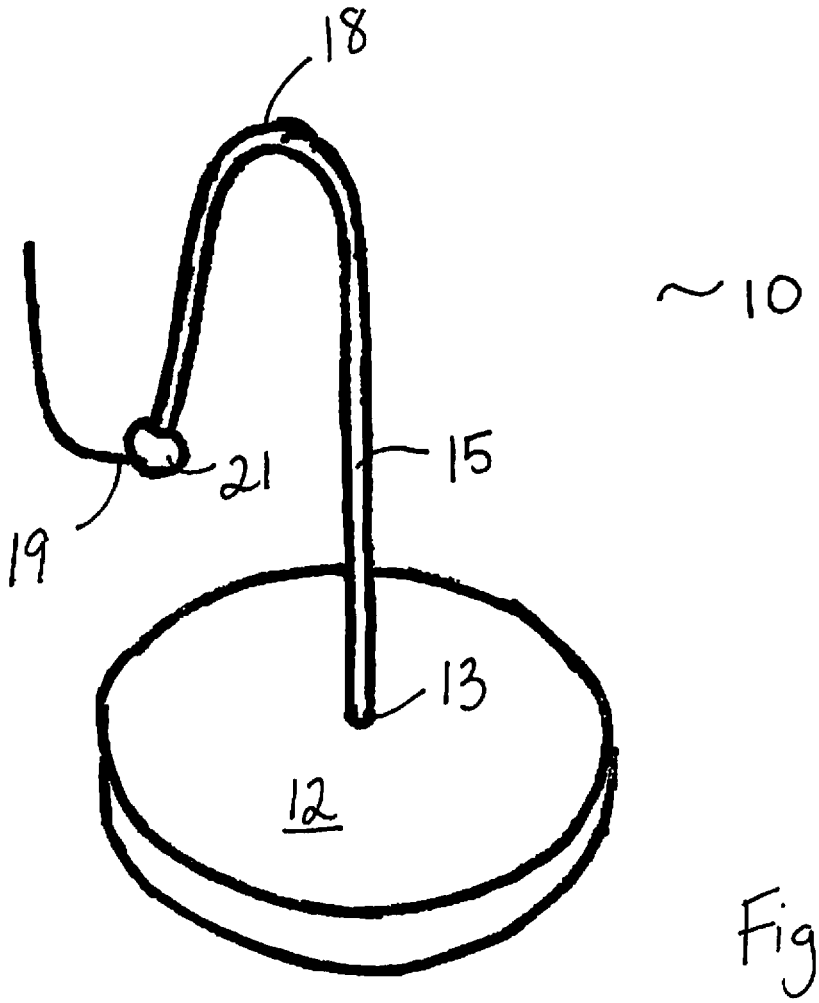
FIG. 1 is a perspective view of the subject apparatus.

FIG. 1 is a perspective view of an embodiment of the subject apparatus 10. In this embodiment, a sturdy base 12 supports wire guide 15 which is secured by friction in a hole 13 in base 12. The base can be made of many suitable materials such as shaped wood or metals or molded plastics, all of which can be provided in attractive finishes and shapes. For example, the base may be made of aluminum or steel formed sheets, polished wood, olefin polymer resins or styrenes, copolymers or any other suitable material. A non-skid bottom surface can be utilized as well. Other means of attachment such as screw threads or a bolt and nut arrangement can be used to secure wire guide 15 to base 12. Wire guide 15 can be metal of sufficient strength and deflection resistance to support a piece of jewelry placed thereon for manipulation by the user of the device. It is anticipated that other materials may be used if sufficiently strong and durable. Reinforced plastics or a wood post can be utilized in other embodiments. In FIG. 1, wire guide 15 has a first or top bend 18 to direct the wire toward a second or lower bend 19 which directs wire tip 17 to a position for receiving one end of a piece of jewelry.

In the aforementioned description, wire guide is used to describe the upper portion of the generally vertical member configured to engage a jewelry object by a typical user of the device. The remainder of the vertical member can be a variety of shapes and diameters as may be desired so long as it provides sufficient strength and stability to the overall device. The distal portion of the vertical member need only be a rigid guide or other suitably strong component effective for engaging a jewelry link or clasp.

Also seen in FIG. 1 is optional stopper bead 21 which prevents the end of a jewelry work piece from traversing too far along guide wire 15. Stopper 21 may be made of any suitable shape or material and preferably will accentuate the style of the apparatus, e.g. as with a crystal bead.

Figure 2:
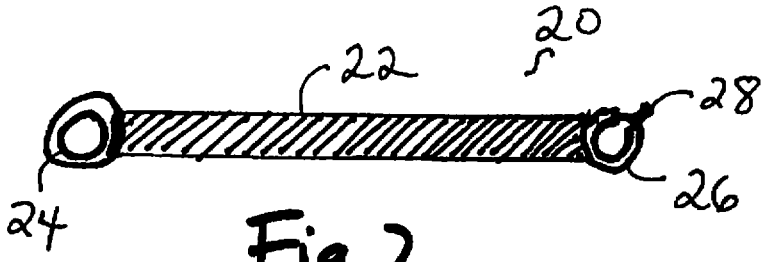
FIG. 2 is a front elevation view of a jewelry work piece used with the subject apparatus and method.

FIG. 2 is a front elevation view of an exemplary jewelry work piece, in this case a bracelet 20, used with the subject apparatus and method. Bracelet interior length 22 has a closure ring 24 at one end and a jewelry hoop clasp 26 at its opposite end. The clasp 26 has a grip 28 so that a user may open the clasp.

Figure 3:
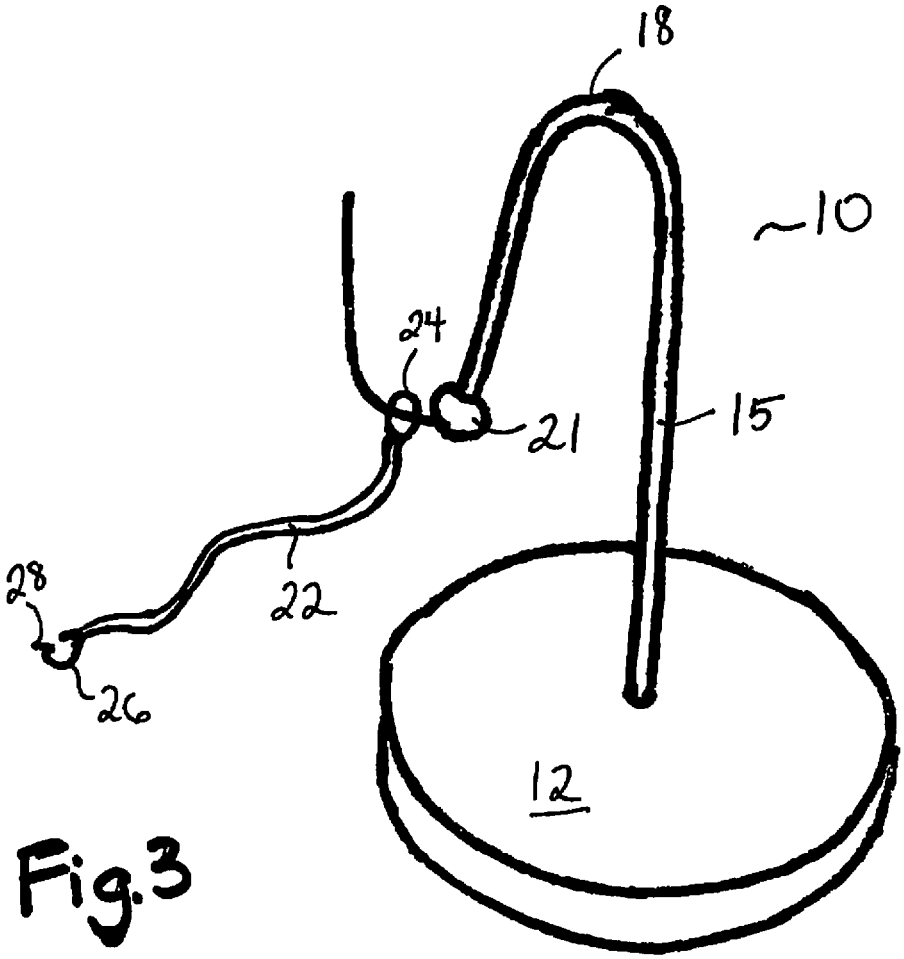
FIG. 3 is a perspective view of the apparatus of FIG. 1 combined with the object of FIG. 2.

FIG. 3 is a perspective view of the apparatus of FIG. 1 wherein bracelet 20 has been hung on wire guide 15 by bracelet hoop 24 at bend 19 and stopped by stopper 21.

Figure 4:
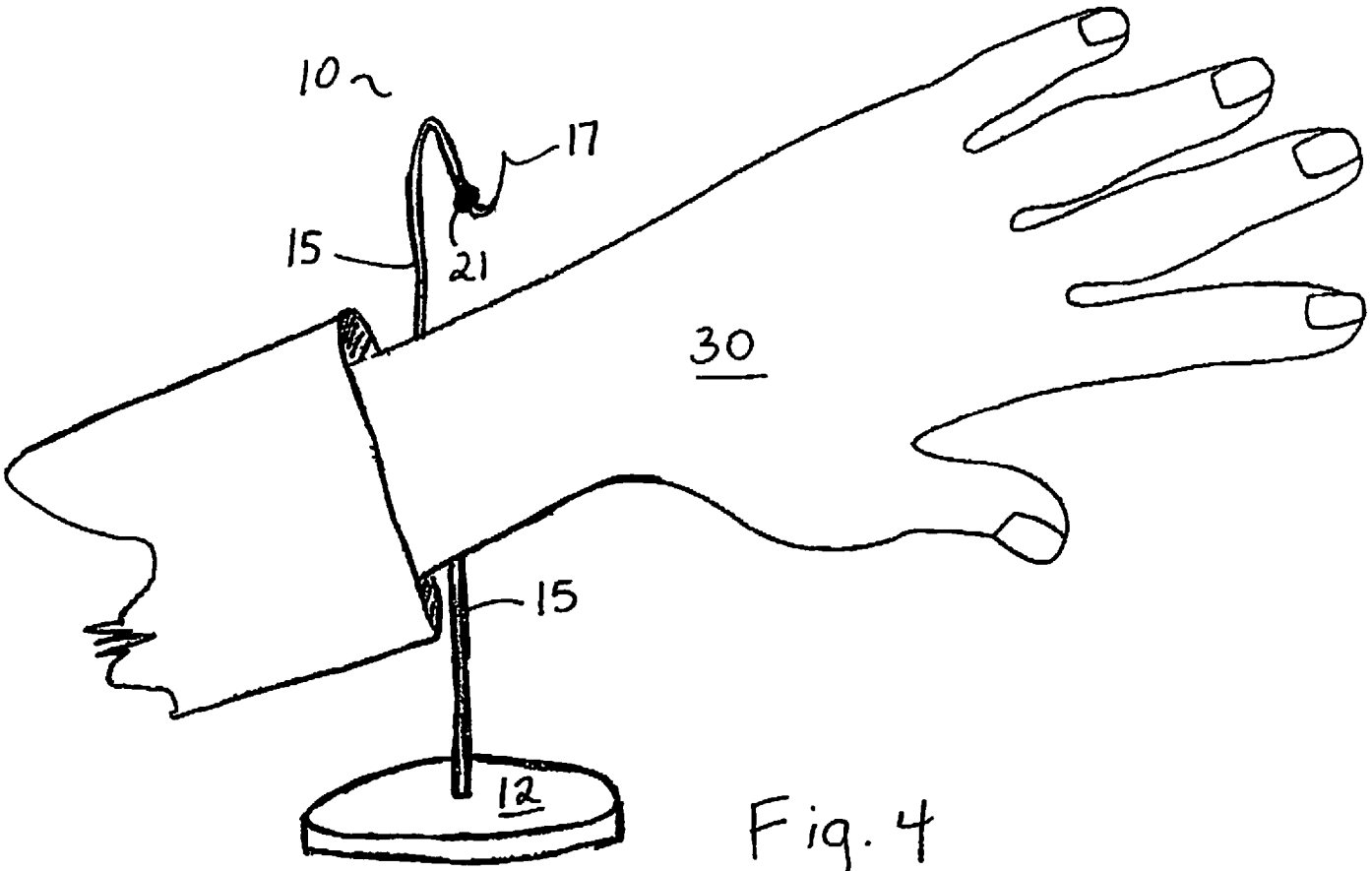
FIG. 4 is a perspective view of a user engaging the apparatus of FIG. 1.

FIG. 4 is a perspective view of a user 30 engaging the apparatus 10 of FIG. 1 by placement of the wrist near the device approximately under stopper 21 on wire guide 15.

Figure 5:
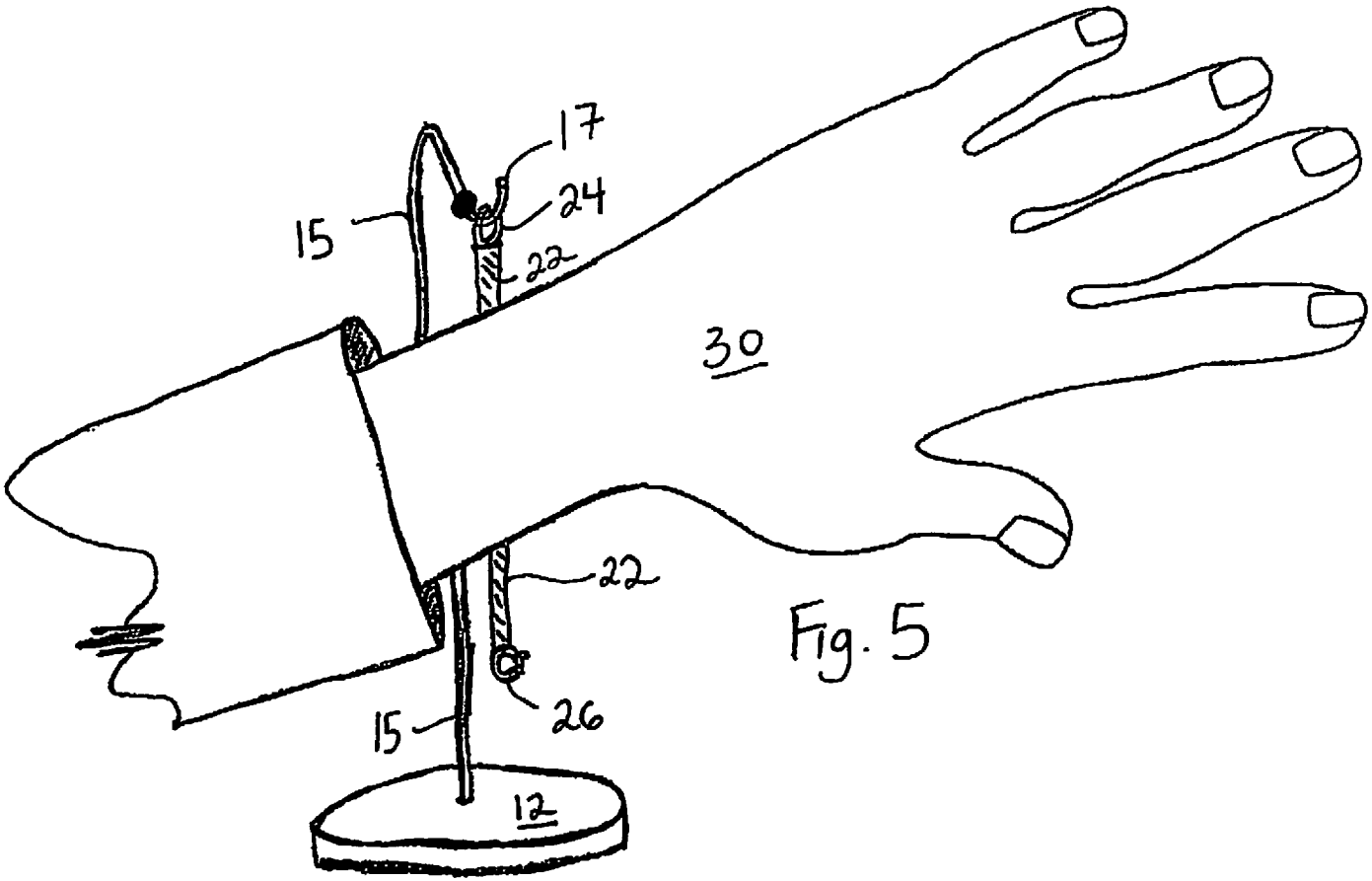
FIG. 5 is a perspective view of a user engaging the apparatus of FIG. 1 and the work piece of FIG. 2.

FIG. 5 is a perspective view of a user 30 engaging the apparatus of FIG. 1 wherein bracelet 20 has been hung on wire guide 15 by placing wire tip 17 through jewelry hoop 24 and left to rest at bend 19.

Figure 6:
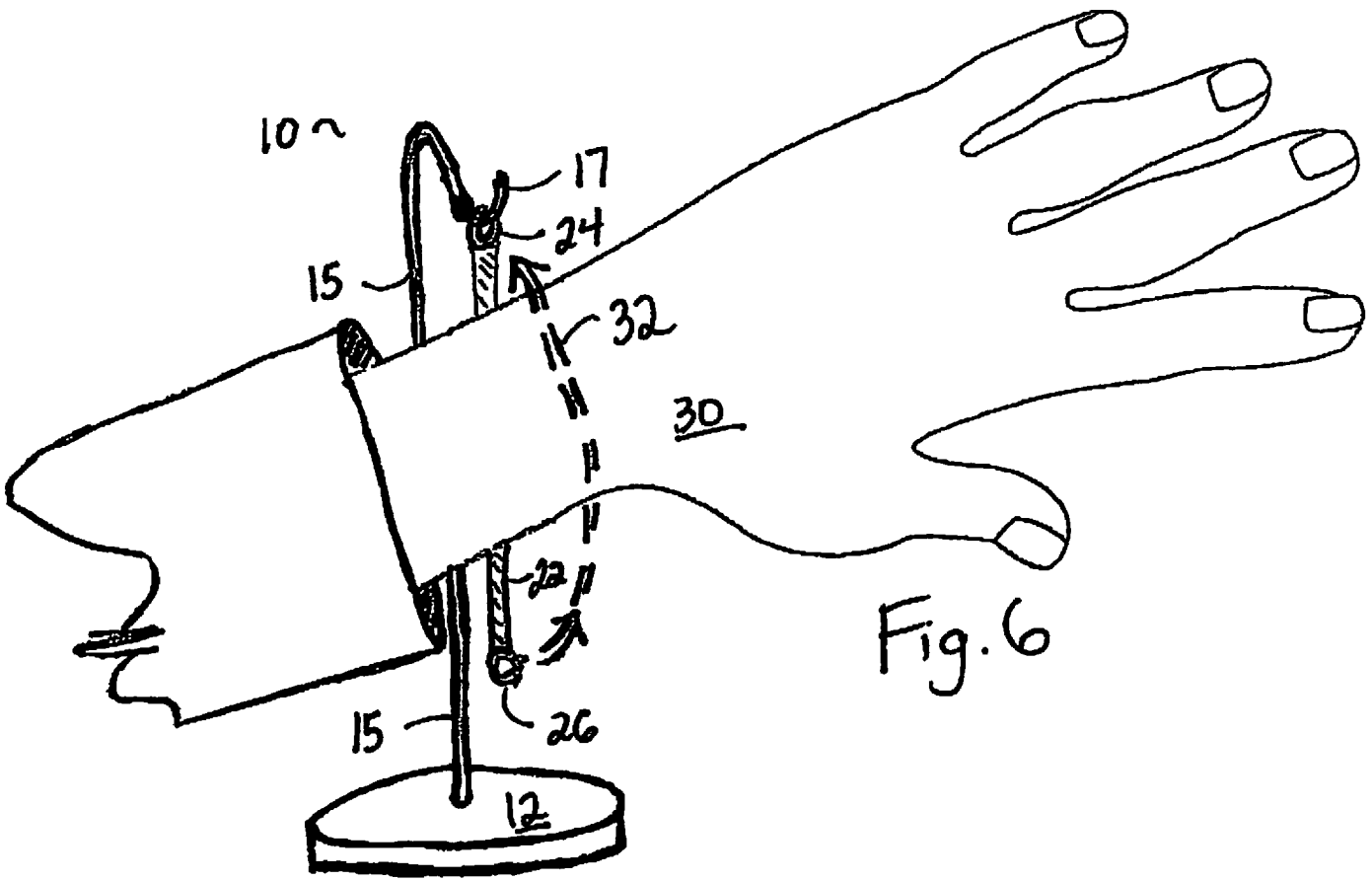
FIG. 6 is a schematic view of a user employing the method of the invention.

FIG. 6 is a schematic view of a user 30 employing the apparatus and method of the invention by manipulating bracelet 20 with clasp 26 along path 32 to approach bracelet hoop 24 placed on wire bend 19. After clasp 26 is attached to hoop 24, the bracelet 20 may be slipped off wire tip 17 while remaining on the wrist of user 30.

Figure 7:
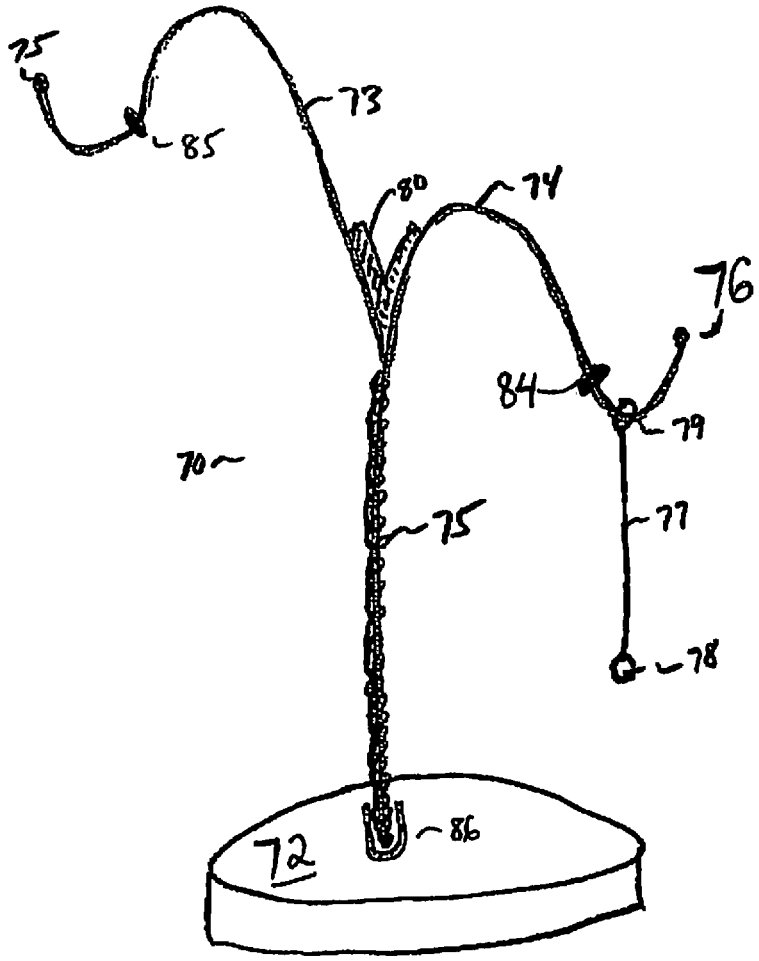
FIG. 7 is a perspective view of an alternative embodiment of the subject apparatus.

FIG. 7 is a perspective view of an alternative embodiment of the subject apparatus 70. In this embodiment, sturdy base 72 secures dual-wire guides namely upper wire guide 73 and lower wire guide 74. Reinforcing wire 75 may be utilized for support or ornamentation. Such a dual-wire (or multi-wire) system may be useful to offer convenience to the user. In this embodiment, jewelry may be slipped onto either wire guide at tips 75, 76 respectively. Alternatively, one of the tips 75 or 76 may be replaced with a clip or clasp, such as an alligator clip for a more firm grasp of a variety of jewelry types, including those not having a hoop or link as discussed in the prior embodiments. This figure also depicts bracelet 77 positioned on wire guide 74 via hoop 79. FIG. 7 shows optional sleeve 86 in the base for supporting the guide wire while in use but facilitating storage or travel convenience. Optional stopper beads 84, 85 are seen on guide wires 74, 73 respectively. Also in this embodiment is depicted optional screw-clasp assistant 80 shown in further detail in FIG. 8.

Figure 8:
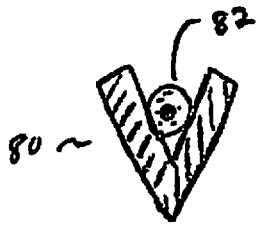
FIG. 8 is a detailed view of a portion of the device shown in FIG. 7.

FIG. 8 is a detailed view of a portion of the device 70 shown in FIG. 7, where screw-clasp assistant 80 is a friction grip of rubber, plastic or metal which may hold one end of a screw-type clasp or closure 82 to facilitate attachment of its complementary mating part.

The foregoing device as described can be used in a jewelry system to facilitate wearing of jewelry items which have hoop and clasp closures, the device comprising a base or clamp for stabilizing the device on a surface; a wire guide member orthogonal to the base and affixed securely thereto, the wire guide having hook or loop at its opposite and for engaging a distal hoop link on an unclasped jewelry item, thereby permitting a person to:

a. engage one end of a jewelry object with the device,
b. open a complementary jewelry clasp with one or both free hands,
c. position a wrist or neck within the bight of the jewelry item,
d. close the clasp upon the hoop link, and
e. slidably remove the clasped jewelry item from the device.

The invention now being fully described, it will be apparent to one of ordinary skill in the art that many changes and modifications can be made thereto without departing from the spirit or scope of the invention as set forth herein.

I claim:

1. A jewelry assistance apparatus comprising:

a base for stabilizing the apparatus during use;

a generally vertical and rigid wire guide member extending from the base, wherein the vertical member has at least two portions comprising a lower portion secured to the base and an upper portion, both lower and upper portions having sequential arcuate bends;

the upper portion has a diameter relatively smaller than the lower portion and includes a second bend and extends toward the base and terminates with a stopper;

said second bend having a straight portion oriented in an angular direction extending toward the generally vertical member and an arcuate portion extending generally perpendicularly towards the vertical member;

the lower portion extending vertically from the stopper and transitioning into a first bend, the second bend extending downwardly towards the base and terminating into a hole in the base.

2. The apparatus of claim 1 wherein the vertical member has a distal U-shaped loop for engaging the jewelry object and configured for permitting the jewelry object to rest therein.

3. The apparatus of claim 1 wherein the stopper is a decorative bead.

4. The apparatus of claim 3 wherein the stopper is engaged with the distal bend and configured to prevent a jewelry object from traversing a further length of the vertical member toward the base.

5. The apparatus of claim 1 wherein the base is fabricated from metal, wood or molded thermoplastic resin.

6. The apparatus of claim 1 further comprising a distal tip.

7. The apparatus of claim 1 further comprising a clip, clasp or clamp member.

8. The apparatus of claim 1 further comprising a friction grip screw-clasp assistant configured to fasten a twist clasp.

9. A method for facilitating the wearing of certain types of lengthy jewelry, such as bracelets and necklaces, a jewelry assistance apparatus comprising:

a base for stabilizing the apparatus during use;

a generally vertical and rigid wire guide member extending from the base, wherein the vertical member has at least two portions comprising a lower portion secured to the base and an upper portion, both lower and upper portions having sequential arcuate bends;

the upper portion has a diameter relatively smaller than the lower portion and includes a second bend and extends toward the base and terminates with a stopper;

said second bend having a straight portion oriented in an angular direction extending toward the generally vertical member and a arcuate portion extending generally perpendicularly towards the vertical member;

the lower portion extending vertically from the stopper and transitioning into a first bend, the second bend extending downwardly towards the base and terminating into a hole in the base; the method comprising the steps of:

a. engaging one end of a jewelry item with a device comprising a base for stabilizing the device on a surface; a wire guide member orthogonal to the base and affixed securely thereto, the wire guide having hook bend at its opposite end for engaging a distal hoop link on an unclasped jewelry item having a complementary jewelry clasp, thereafter:

b. opening a the complementary jewelry clasp with one or both free hands, c. positioning a wrist or neck within a bight of the jewelry item, d. closing the clasp upon the hoop link, and e. slidably removing the clasped jewelry item from the device.

* * * * *